US007232018B1

(12) United States Patent
Salander

(10) Patent No.: US 7,232,018 B1
(45) Date of Patent: Jun. 19, 2007

(54) COLLAPSIBLE LUGGAGE SYSTEM

(75) Inventor: Mark T. Salander, Barrington, RI (US)

(73) Assignee: The Gem Group, Inc., Lawrence, MA (US)

( * ) Notice: Subject to any disclaimer, the term of this patent is extended or adjusted under 35 U.S.C. 154(b) by 223 days.

(21) Appl. No.: 10/944,308

(22) Filed: Sep. 17, 2004

(51) Int. Cl.
*A45C 7/00* (2006.01)
*A45C 5/14* (2006.01)

(52) U.S. Cl. ..... 190/108; 190/18 A; 190/103; 190/107; 190/109; 280/37; 383/2; 383/4

(58) Field of Classification Search ..... 190/18 A, 190/102, 107–110, 127, 103–105; 383/32, 383/37, 2, 4; 280/37; 220/6–8
See application file for complete search history.

(56) References Cited

U.S. PATENT DOCUMENTS 4,375,828 A * 3/1983 Biddison ..... 383/41
4,756,394 A * 7/1988 Cohen ..... 190/18 A
4,941,603 A * 7/1990 Creamer et al. ..... 224/148.3
D364,959 S * 12/1995 Finn ..... D3/279
5,660,476 A * 8/1997 DeCoster ..... 383/29
5,749,446 A * 5/1998 Hsieh ..... 190/107
5,873,504 A * 2/1999 Farmer ..... 224/576
6,015,072 A * 1/2000 Young ..... 224/153
6,129,254 A * 10/2000 Yu ..... 224/575
6,179,182 B1 * 1/2001 Hayes ..... 224/408
2002/0125669 A1 * 9/2002 Chang ..... 280/79.11
2005/0016810 A1 * 1/2005 Feng ..... 190/115
2005/0034949 A1 * 2/2005 Davies ..... 190/107

FOREIGN PATENT DOCUMENTS

GB 2031718 A * 4/1980

* cited by examiner

*Primary Examiner*—Sue A. Weaver
(74) *Attorney, Agent, or Firm*—William A. Loginov; Hinckley, Allen & Snyde LLP

(57) ABSTRACT

This invention provides a structured luggage system that allows for maximum versatility in luggage piece dimensions and using two luggage pieces. Each of the two luggage pieces can be converted from a full-height luggage piece to an approximately half-height piece with relative ease. The lower or main piece includes conventional wheels and a retractable/extendible handle for easy transport. The upper or secondary piece is adapted to stack on and be secured to the extended handle and (in full-height configuration) offer a secondary grip for added stability adjacent to the handle grip. The lower piece includes an inner central septum that can be sealed or opened to selectively define either a two-compartment piece or large, single compartment piece. Each compartment includes easily removable stiffeners in corresponding side pockets. By removing the upper compartment stiffeners, the pocket can be collapsed into a thickened top that includes the septum as the thickened top's inside face. By also removing the bottom set of stiffeners, the bottom compartment can be collapsed, allowing the entire main/lower piece to be compressed for easy storage.

11 Claims, 19 Drawing Sheets

COLLAPSIBLE LUGGAGE SYSTEM

BACKGROUND OF THE INVENTION

1. Field of the Invention

This invention relates to semi-rigid "structured" luggage and more particularly to integrated sets of luggage with collapsible features.

2. Background Information

Luggage is an essential part of business and pleasure travel. As the needs of travelers become more varied, it is highly desirable to provide luggage that can meet those varied demands. Sometimes a large set of luggage is needed, while other times, only a small bag is called for. Often a luggage piece must fill the dual roles of checked baggage and around-the-town tote. In homes and hotels storage is often at a premium. Providing a wide range of specialized luggage pieces to fill all the different luggage needs that may arise, may undesirable tax that storage space.

In addition, travelers now generally prefer wheeled luggage, providing a versatile luggage system that also allows for easy, wheeled motion is highly desirable.

SUMMARY OF THE INVENTION

This invention overcomes the disadvantages of the prior art by providing a structured luggage system that allows for maximum versatility in luggage piece dimensions and using two luggage pieces. Each of the two luggage pieces can be converted from a full-height luggage piece to an approximately half-height piece with relative ease. The lower or main piece includes conventional wheels and a retractable/extendible handle for easy transport. The upper or secondary piece is adapted to stack on and be secured to the extended handle and (in full-height configuration) offer a secondary grip for added stability adjacent to the handle grip. The lower piece includes an inner central septum that can be sealed or opened to selectively define either a two-compartment piece or large, single compartment piece. Each compartment includes easily removable stiffeners in corresponding side pockets. By removing the upper compartment stiffeners, the pocket can be collapsed into a thickened top that includes the septum as the top's inside face. By also removing the bottom set of stiffeners, the bottom compartment can be collapsed, allowing the entire main/lower piece to be compressed for easy storage.

Likewise, the upper or secondary piece includes a hinged stiffened bottom that allows for foldable compression of the lower piece and easy storage. The upper compartment of the secondary piece can also be selectively compressed into an integral, thickened top flap or expanded to approximately double the volume of the upper piece. In each configuration an appropriate top handle presents itself to the user. In addition a removable shoulder strap is provided to the upper piece. It includes fasteners that allow the strap to be selectively secured near the top, along opposing sides of upper piece to maintain stability when the upper piece is fully expanded. In addition, the inner volume of the lower piece's lower compartment is sufficient to store the upper piece (in various compressed configurations), thereby providing another technique for compact storage of the system.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
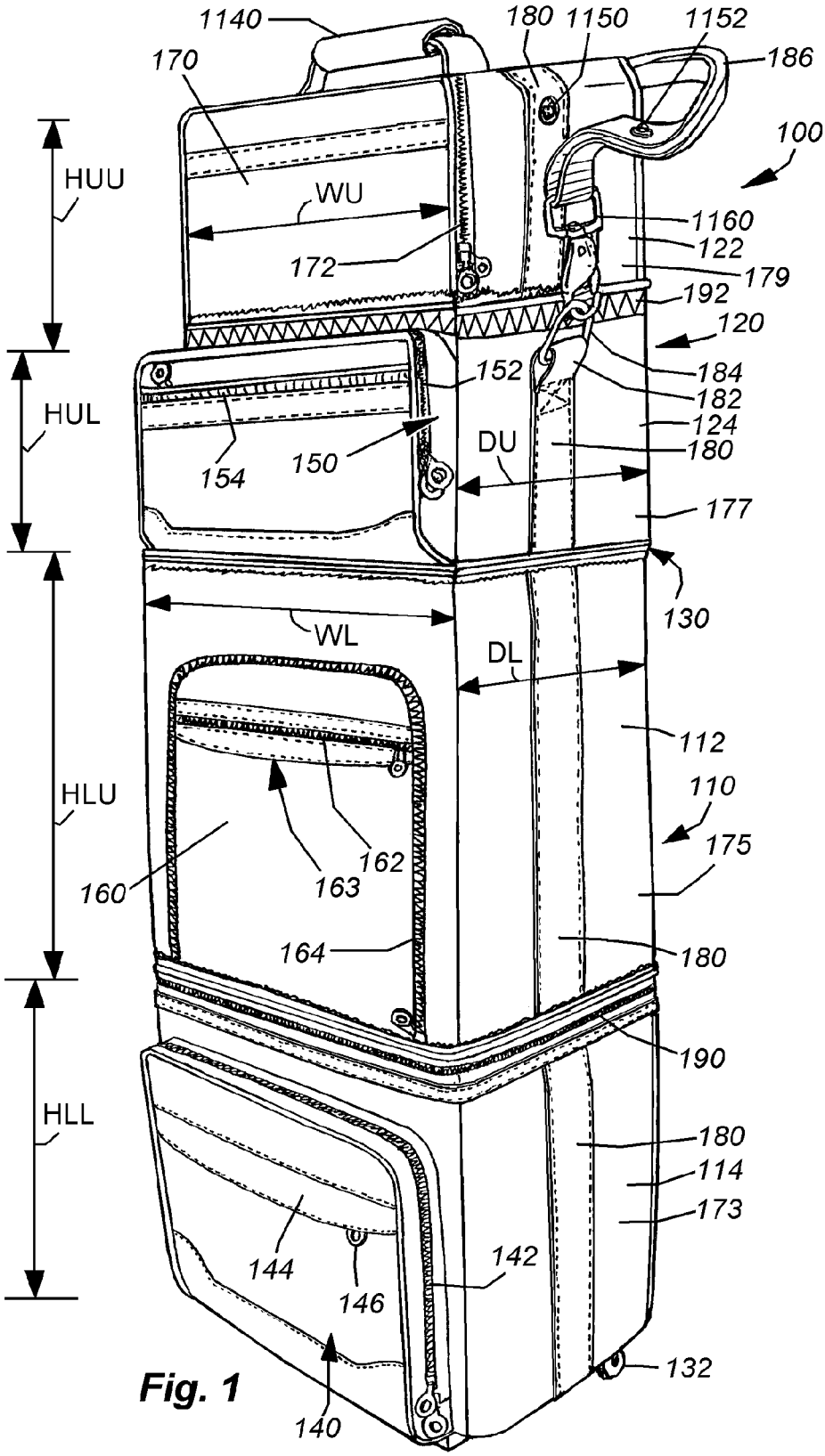
FIG. 1 is a front perspective view of the structured luggage system according to an illustrative embodiment of this invention with both the main or lower and secondary or upper piece fully expanded.

FIG. 1 shows a front perspective view of a set of structured luggage 100 according to an embodiment of this invention. The set 100 consists of two pieces in this example, a main or "lower" piece 110 and a secondary or "upper" piece 120. The pieces 110 and 120 are stacked atop each other (with dividing line 130 between pieces) in this example ready for transport by a traveler using, for example, built-in travel wheels 132 at the bottom (described below) of the lower piece 110. The size, shape and stacking arrangement of the pieces is highly variable and terms like "horizontal," "vertical," "front," "rear," "upper" and "lower" are to be taken only as conventions for describing one exemplary arrangement, as illustrated herein. Likewise, the precise number of pieces in the set is highly variable. In this example, two pieces are shown and described.

As will be described in detail below, each piece 110 and 120 can be fully expanded for maximum storage capacity as shown in FIG. 1. As such, the lower piece 110 defines both an upper compartment 112 and a lower compartment 114. Likewise, the upper piece 120 defines a corresponding upper compartment 122 and a lower compartment 124.

As shown in FIG. 1, each piece 110 and 120 is fully expanded for maximum storage capacity in this illustration. While the size of each piece, and the size/volume of the separate compartments in each piece, may vary significantly in height, width and depth, a generalized example can have the following dimensions: height HLL of the lower compartment 114 of the lower piece 110 of 12–14 inches; height HLU of the upper compartment 112 of the lower piece 110 of 12–14 inches; width WL of the lower piece 110 (both compartments) of 15–17 inches; depth of the lower piece 110 (both compartments) DL of 7–9 inches; height HUL of the lower compartment 124 of the upper piece 120 of 6–9 inches; height HUU of the upper compartment 122 of the upper piece 120 of 12–14 inches width WU of the upper piece 120 (both compartments) of 14–16 inches and depth DU of the upper piece 120 (both compartments) of 5–7 inches. Again, the height of any given compartment in this exemplary set can vary with respect to the height of another compartment. Likewise, the overall depth and width DU and WU of the upper piece 120 can be the same as that (DL, WL) of the lower piece 110 or can be (as described in certain illustrations below) less than that of the lower piece 110.

The upper piece 120 and lower piece 110 can include conventional front pockets or pouches. For example, the lower piece's lower compartment 114 includes a front pouch 140 having a zippered closure 142 and a supplemental front face pocket 144 with its own zippered closure 146 formed between material plies of the front material piece of the pouch 140. The upper piece 120 also includes a supplemental pouch or pocket 150 on its front with the zippered closure 152 and an additional zippered closure 154 for accessing an associated face pocket between material plies. The lower piece 110 has a three-sided rectangular opening flap 160 with a face pocket 163 accessed by a zippered closure 162. The flap 160 includes its own separate closure 164 that allows access to the upper compartment 112. Likewise, the upper compartment 122 of the upper piece 120 includes a front flap 170 with a three-sided zippered closure 172 for easy access.

As will be described further below, the luggage pieces of this embodiment are termed "structured" in that they are constructed from multiple plies of fabric with stiffeners that can be removed. In this manner, the pieces can be adapted to exhibit both a soft-sided, bag-like feel and, when desired, a more rigid semi-hard-sided feel. The materials used to construct the bags are widely variable. In one embodiment, the exterior material is a woven nylon such as Dupont Cordura®. This material can be reinforced with various gussets and webbing, such as the reinforcing side webbing 180 disposed along each pieces side. Note as used herein the terms "side" and "sidewall" can refer to piece faces 173, 175, 177 and 179 disposed between opposing front and real faces of the pieces/compartments. Note that the reinforcing webbing 180 terminates in the lower compartment 124 of the upper piece 120 at a sewn loop 182 that attaches to a metal or plastic D-ring 184. The D-ring 184 allows attachment of a shoulder strap 186 that will described further below. The inner material of the pieces, acting as a liner, can vary. It can be a smooth satin-like liner material and/or a waterproof rubberized material where appropriate. The liner for the lower piece 110 can differ in texture and material from that of the upper piece 120 in consideration of differing uses that each piece may be subjected to. For example, the lower piece 110 is more likely to be used as basics travel luggage while the upper piece may be carried around town as a tote upon arrival at a destination.

Each pieces' (110, 120) compartment 114 and 124 is accessed by a top mounted peripheral zippered closure 190 and 192, respectively. Each zippered closure 190 and 192 extends around the sides and front faces of the respective piece 110 and 120. It allows the respective upper compartment 112 and 122 to be hinged back along its rear (unzippered) side to access the lower compartment (114 and 124, respectively). In addition, the lower compartment can be accessed generally in the upper piece 120 through the front flap 170 by reaching down through the open flap into the lower compartment 124. Likewise, under certain circumstances that will described below, the lower compartment 114 of the lower piece 110 can be accessed through the flap 160 when the septum (described below) is not in place to separate the two compartments 112 and 114.

Figure 2:
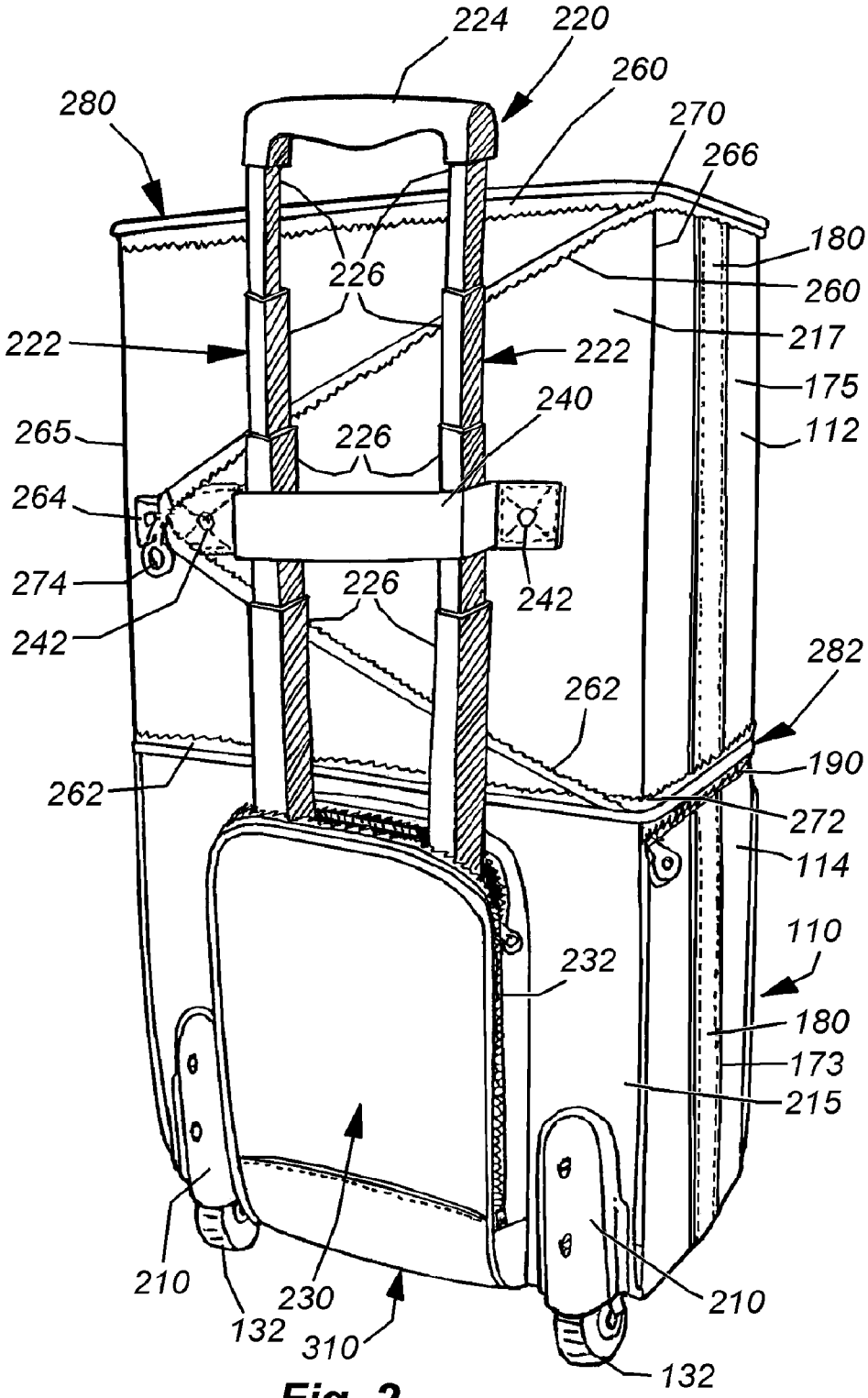
FIG. 2 is a rear perspective view of the lower piece fully expanded with the handle partially extended.

FIG. 2 illustrates the rear of the lower piece 110 with upper and lower compartments 112 and 114 fully expanded. As described above, a pair of wheels 132 are shown. These are mounted on axle supports 210 that are attached securely to the lower compartment 114 (supported generally by a sturdy stiffener (not shown) within the rear face/side 215 of the lower piece 110 using rivets, screws and other acceptable attachment mechanisms. A retractable handle assembly 220 is shown partially extended. The retractable handle assembly 220 can be any conventional design with tubular, square or another cross-section shape support rods 222. The rods 222 are topped by a grip handle 224 constructed from metal plastic or another suitable material. The rods 222 are constructed as a series of nested segments 226 that allow the handle 220 to be extended to a maximum height generally in line with the top of the set when fully expanded and stacked as shown in FIG. 1. The rods 222 can be retracted so that they seat completely within a handle pouch 230 located at the rear of the lower compartment 114. The handle pouch 230 includes a three-sided zippered closure 232 that allows the handle to be completely concealed when not in use. The rear face/side 217 of the upper compartment 112 includes a webbing strap 240 attached along the side of each handle at an attachment point 242 with respect to the rear side of the upper compartment 112. The strap 240 allows the handle 224 and rods 222 to be passed therethrough to further stabilize the upper compartment against the handle 220 when the upper compartment 112 is fully extended. Otherwise, it is possible that the semi-rigid structure of the bag would cause the upper compartment to flop forwardly away from the handle. Note that the rods can include a variety of locking mechanisms (not shown) such as conventional spring loaded lock-buttons that allow the handle to be secured in the extended position or in any number of intermediate-linked positions as needed. The number of segments used in the rods 222 are highly variable.

The rear face of the upper compartment 112 of the lower piece 110 includes a pair of opposing zipper halves 260 and 262 that extend from a central point 264 adjacent to a corner 265 of the face at angles to an opposing corner 266 of the face. From the corner 266 each zipper half 260 and 262 runs around the entire perimeter of the respective top and bottom of the compartment 112 until they intersect back at the corner at a respective intersection points 270 and 272 as will be described further below, this geometry allows the upper compartment, with stiffeners removed, to be zipped into a compressed configuration. In other words, as the zipper end 274 is moved across the rear face from the point 264 to the corner 266, the top and bottom sides 280 and 282 of the upper compartment 112 are forced together by the movement of the angled zipper halves toward each other. The top and bottom sides 280 and 282 of the upper compartment 112 are then sealed to each other with the material the compartment walls compressed therebetween by running the zipper end 274 around the perimeter of the compartment 112 to fully join the zipper halves 260 and 262 together resulting top is shown in further detail in FIG. 8 (described below).

Figure 3:
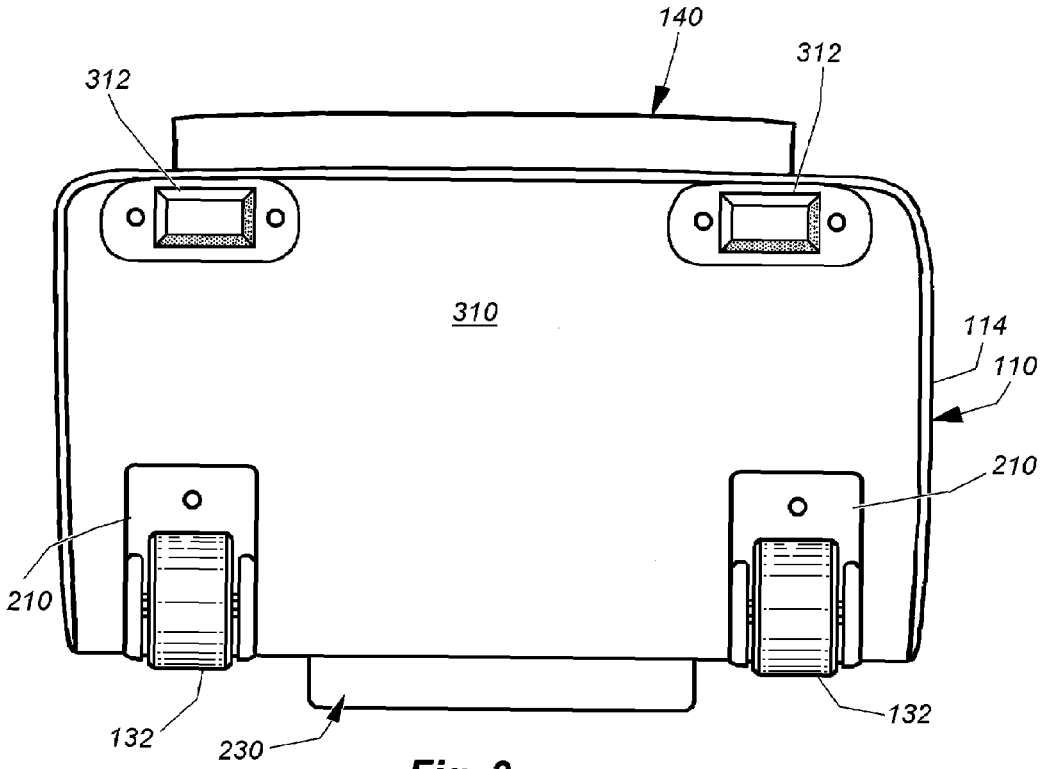
FIG. 3 is a bottom view of the lower piece showing travel wheels and rests.

With brief reference to FIG. 3, the bottom side 310 of the lower piece 110 is shown in further detail. The axle supports 210 for the wheels 132 are detailed at the rear. Similarly, a set of front feet 312 serve to level the bottom 310 with respect to a supporting surface relative to the extension height of the wheels 132.

Figure 4:
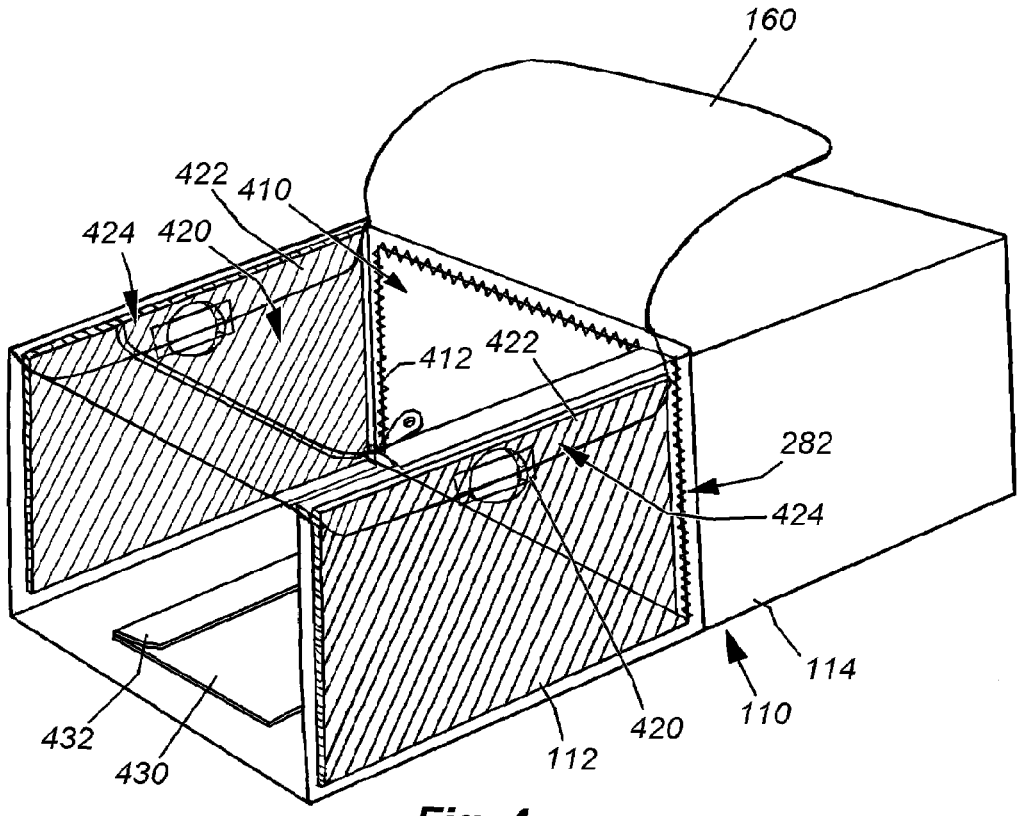
FIG. 4 is a simplified exposed perspective view of the lower piece showing the upper compartment with side stiffeners and septum in place.

FIGS. 4–7 show the internal structure of the upper compartment 112 of the lower piece 110 in further detail. With reference first to FIG. 4, the lower piece 110 is shown with the upper compartment flap 160 hinged open. In this orientation, the upper compartment is accessible to the user. Between the upper compartment 112 and lower compartment 114 is located a septum 410. The septum 410 is a piece of durable fabric, typically without stiffeners installed. In alternate embodiments, it can include an appropriate stiffener. The septum is joined by three-sided zippered closure 412 to the inner walls of the piece 110 midway between the compartments 112 and 114. In fact, the septum is joined to the base 282 of the upper compartment so that, when the zipper 190 (described above) is opened, the septum 410 hinges away attached to (and defining) the bottom side the upper compartment to expose the lower compartment 114. The upper compartment 112 also includes a pair of side pouches 420 disposed along the interior of each sidewall of the compartment. The pouches each include a flap 422 that is secured over an opening in the pouch by a hook and loop fastener assembly 424. A variety of fasteners can be used to secure the flap 422. In alternate embodiments, flaps can be omitted entirely. In addition, a narrower pouch 430 with a flap 432 is located along the inner rear face of the compartment 112. This pouch rests generally over the location of the handle 220 described above.

Figure 5:
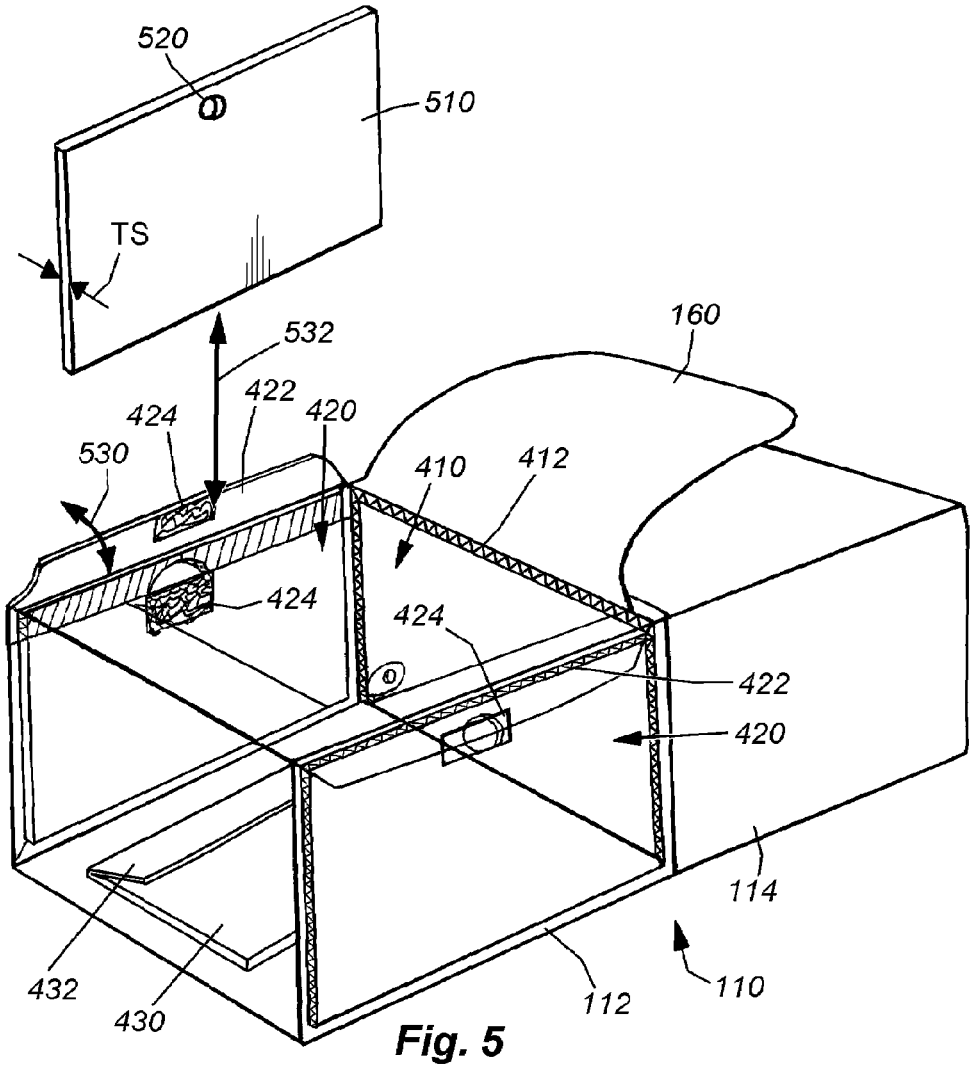
FIG. 5 is a simplified exposed perspective view of the lower piece showing the upper compartment and detailing the removal of a side stiffener.

With further reference to FIG. 5, within each interior side pouch 420 is located a semi-rigid stiffener panel 510. The stiffener panel can be constructed from a semi-rigid durable plastic such as polyethelene sheet that can have a thickness TS in the range of 1/16 to 1/8 inch. Actual thicknesses can vary widely. In this embodiment, the sheet 510 includes a hole or other orifice 520 adapted to be located adjacent to the flap 422 for ease of withdrawal of the sheet 510 from the pouch 420. As shown, the pouch flap 422 is opened (double arrow 530) to facilitate installation and withdrawal of the sheet by passing (double arrow 532) the sheet through the opening to find adjacent to the flap 422.

Figure 6:
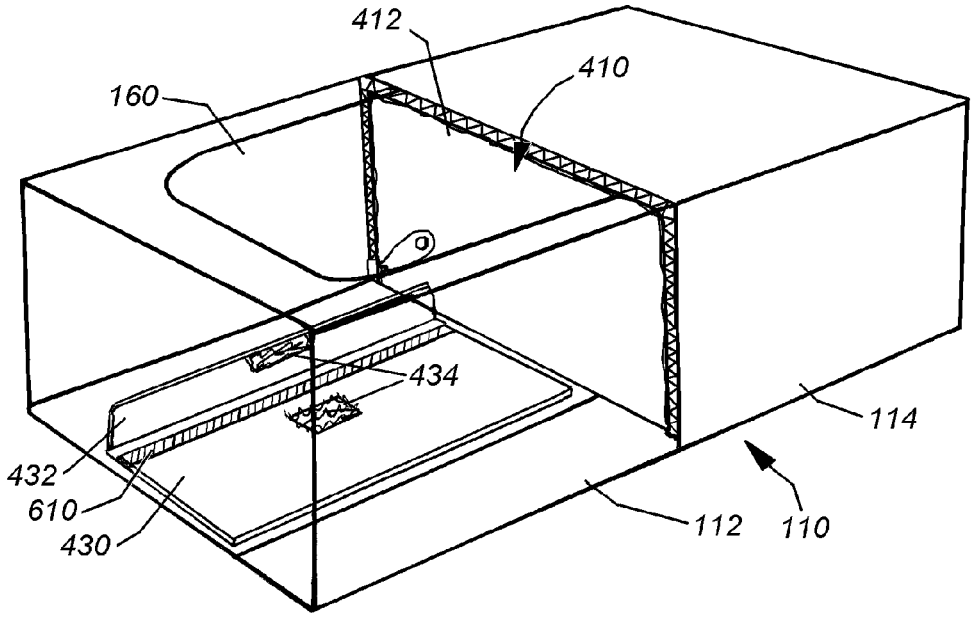
FIG. 6 is a simplified exposed perspective view of the lower piece showing the upper compartment and detailing a rear inner face pocket for storage of a rear side stiffener.

With further reference to FIG. 6, the rear face pouch 430 and associated flap 432 are opened by separating the hook and loop fastener pieces 434 to reveal a rear face stiffener 610. The rear face stiffener can vary in size. In general, it is narrower than the side stiffeners 510 because of the difficulty of moving the stiffener into and out of the rear face. In alternate embodiments, access to the pouch 430 can be through another side—such as through the bottom side adjacent to the septum 410. In general, the stiffener 610 is sufficiently large in surface area to provide desired stiffness to the rear of the compartment 112 when taken in conjunction with the side stiffeners 510.

As described generally above, by removing the upper compartment stiffeners 510 and 610, the upper compartment is converted into a soft-sided bag. Thus, the material can be easily compressed toward the center in a series of overlapping folds by moving the zipper and (see FIG. 2) to join the zipper halves 260 and 262 together. When removed, the stiffeners 510 and 610 can be stored at any acceptable location in or out of the luggage set.

Figure 7:
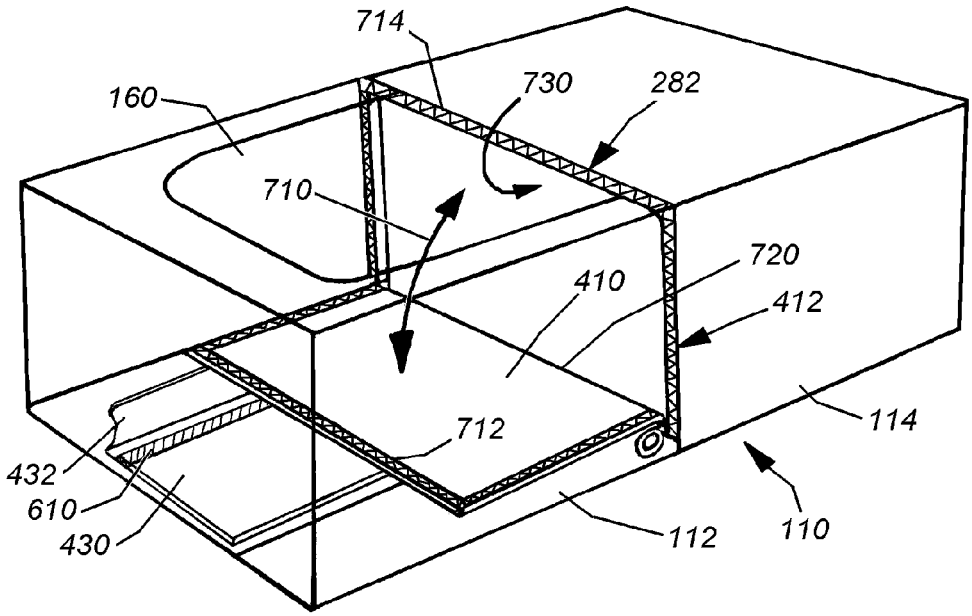
FIG. 7 is a simplified exposed perspective view of the lower piece showing the upper compartment and detailing the opening of the septum between the upper and lower compartment to define a double-sized single compartment.

When the stiffeners are installed, the overall lower piece 110 can be converted into a single large compartment as shown generally in FIG. 7. The septum 410 is hinged open (double arrow 710) by separating the zipper halves 712 and 714 of the three sided zippered closure 412. The septum thus hinges away along its unzippered rear seam 720 creating an opening 730 between the two adjacent compartments 112 and 114. As noted above, when the upper compartment 112 is to be moved into a compressed configuration, the septum typically remains zippered onto the bottom 282 of the upper compartment 112. In this manner, the compressed upper compartment acts as a lid with the septum 410 restraining the material of the upper compartment' walls against infiltration into the lower compartment.

Figure 8:
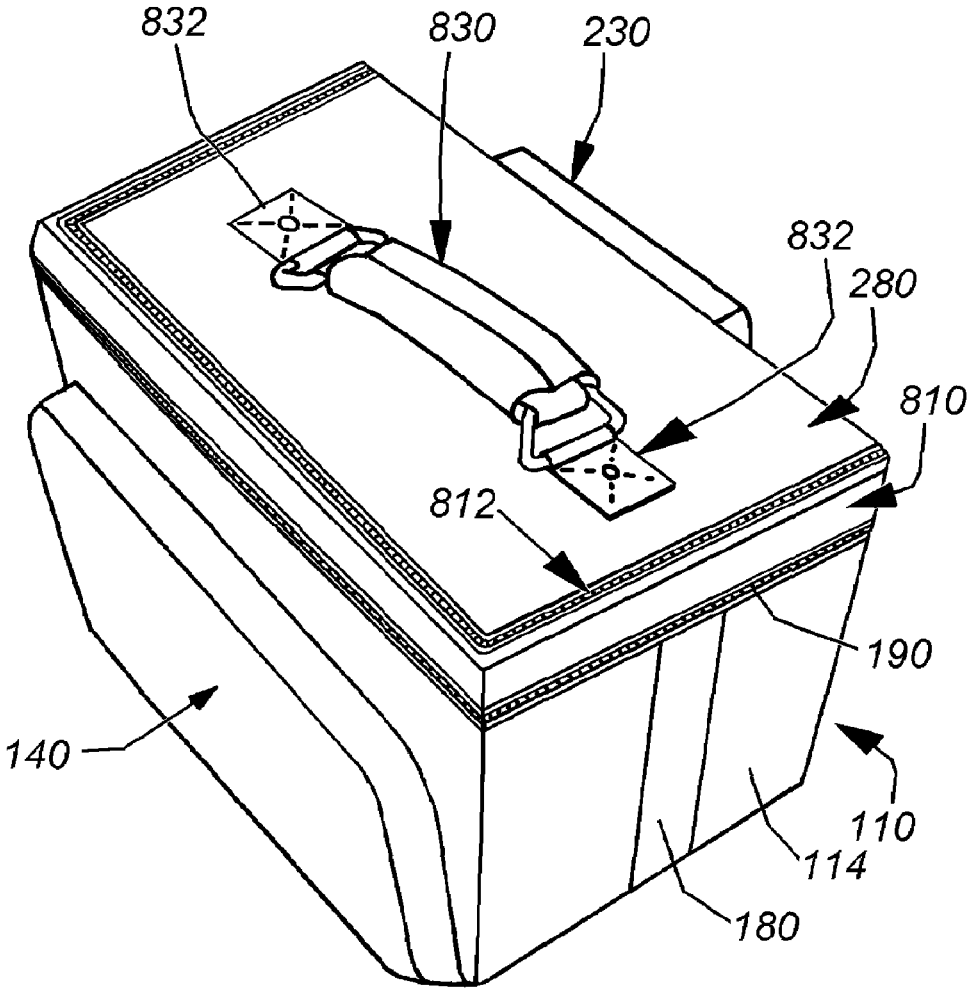
FIG. 8 is a perspective view of the lower compartment of the lower piece with the upper compartment compressed into the top to define an approximately half-sized lower piece.

As shown in FIG. 8, the compressed upper compartment generally defines a thickened lid 810 due to the compressing action of the zipper assembly 812 (including zipper halves 260 and 262). The three-sided zippered peripheral closure 190 between compartments now essentially acts as a lid closure allowing access to the lower compartment interior by unzipping the three sides and allowing the thickened lid 810 to hinge along its rear side. Note that the top 280 of the lid 810 (formerly top of the upper compartment 112) can include a handle assembly 830 of conventional design that is secured by bases 832 to the top.

Figure 9:
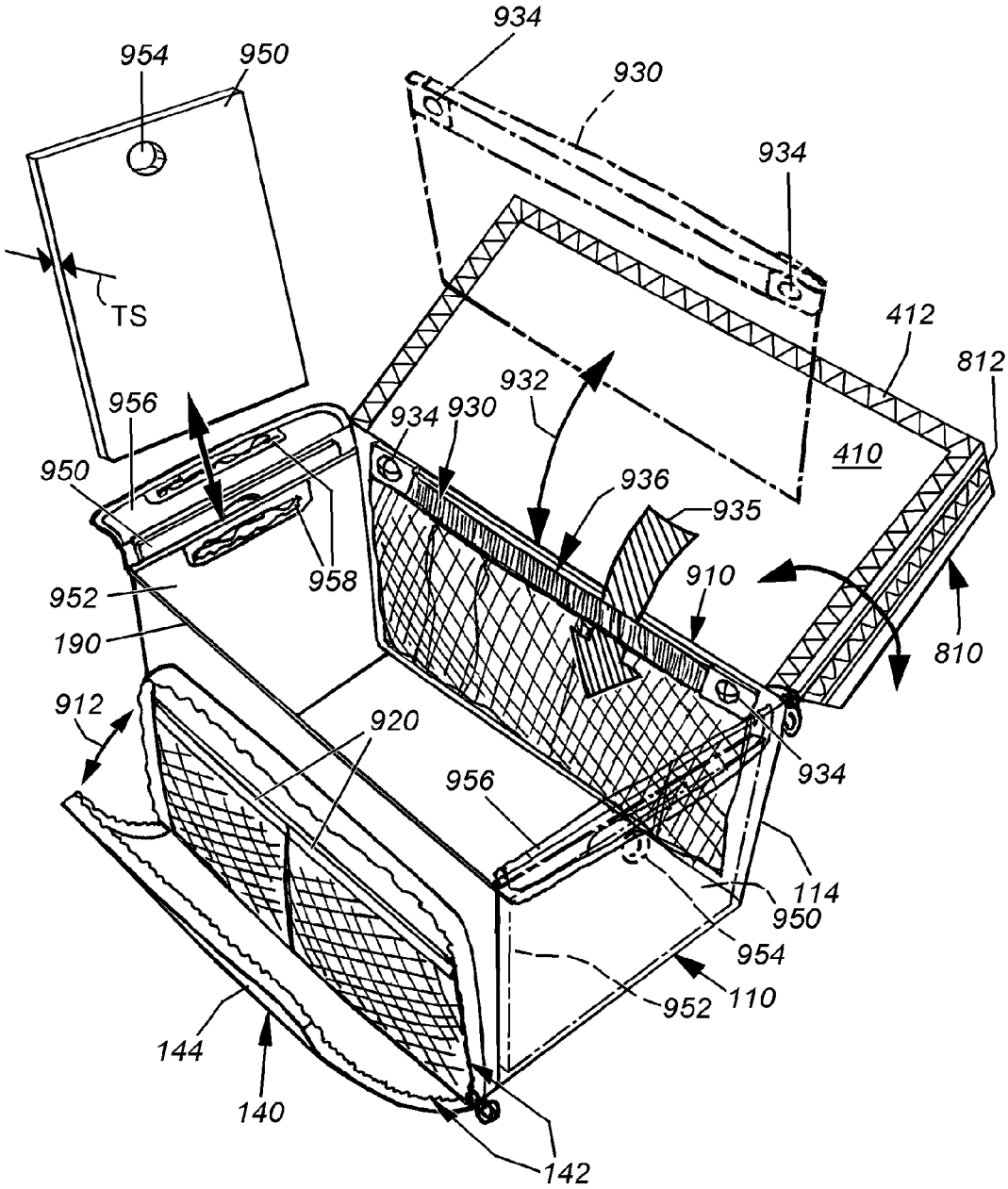
FIG. 9 is a top perspective view of the lower compartment of the lower piece with top opened and the upper compartment compressed thereinto and detailing removal of a side stiffener.

In FIG. 9, the interior of the lower compartment is shown in further detail with the upper compartment compressed so as to form the thickened lid 810. The zipper 190 has been opened to allow the lid 810 to hinge along its rear edge 910. Within this embodiment, the front flap 144 of the pocket 140 has been zipped open (double arrow 912) to reveal the interior of the pocket 140. This interior includes, in this embodiment, a pair of mesh pouches 920. The exact configuration of the pocket is widely variable as is its placement, size and general existence on the piece 110.

The interior of the compartment 114 includes, mounted along the rear interior wall, a removable mesh pouch 930. The pouch can be attached to and removed from the inner compartment rear wall by working the snap fasteners 934 located at each top corner of the pouch. These fasteners engage corresponding fastener bases on the compartment rear wall. The interior storage space of the pouch 930 is accessed (large arrow 935) by passing items between the elastic strips at the top opening 936 of the pouch. The pouch 930 can also include various hooks and/or loops for hanging it on, for example, a shower or bathroom fixture.

As shown clearly in FIG. 9, the lid 810 formed from the compression of the upper compartment 112 is sealed along its bottom side by the septum 410 which is secured to the lid by the three-sided zipper closure 412.

The lower compartment 114 includes appropriate side stiffeners 950 on each of opposing sides. The stiffeners are stored within pouches 952 find on the interior sidewalls of the compartment 114. The stiffeners 950 can be constructed of similar material and have a similar thickness TS to the stiffeners 510 and 610 described above. The stiffeners 950 can include an appropriate grip orifice or a hole 954 for ease of removal from their respective pouches 952. Each of the pouches 952 can be sealed using a movable flap 956 that is secured by an appropriate hook and loop fastener material 958. In this embodiment, the stiffeners 950 on the sides are slightly smaller than the actual side dimension so as to slide easily into the pouches 952. Nevertheless, the stiffeners 950 cover substantially the entire interior surface of the corresponding side interior to provide an effective semi-rigid structure to the lower compartment sidewalls.

Figure 9A:
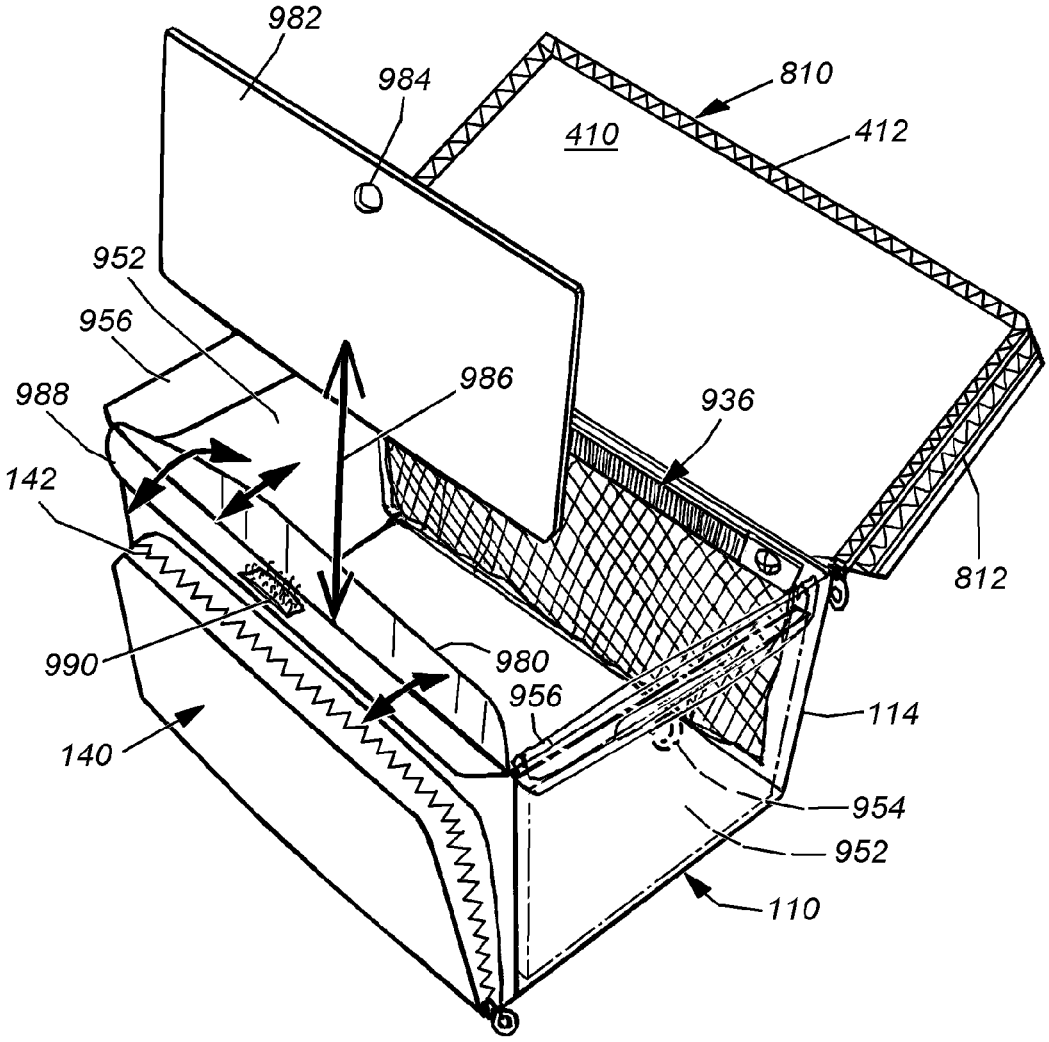
FIG. 9A is a top perspective view of the lower compartment of the lower piece with top opened and the upper compartment compressed thereinto and detailing removal of a front stiffener.

With brief reference to FIG. 9A, a front interior face pouch 980 is provided to receive a front face stiffener 982 in the lower compartment 114. This front stiffener 982 also includes an appropriate gripping orifice 984 and can be moved into and out of the pouch 980 (double arrow 986) by opening the pouch flap 988 after detaching the associated hook and loop fastener 990. The front stiffener 982 has a width and height that are generally similar to the dimension of the inner face so that it provides semi-rigid structure across essentially the entire front face of the compartment 114.

Figure 10:
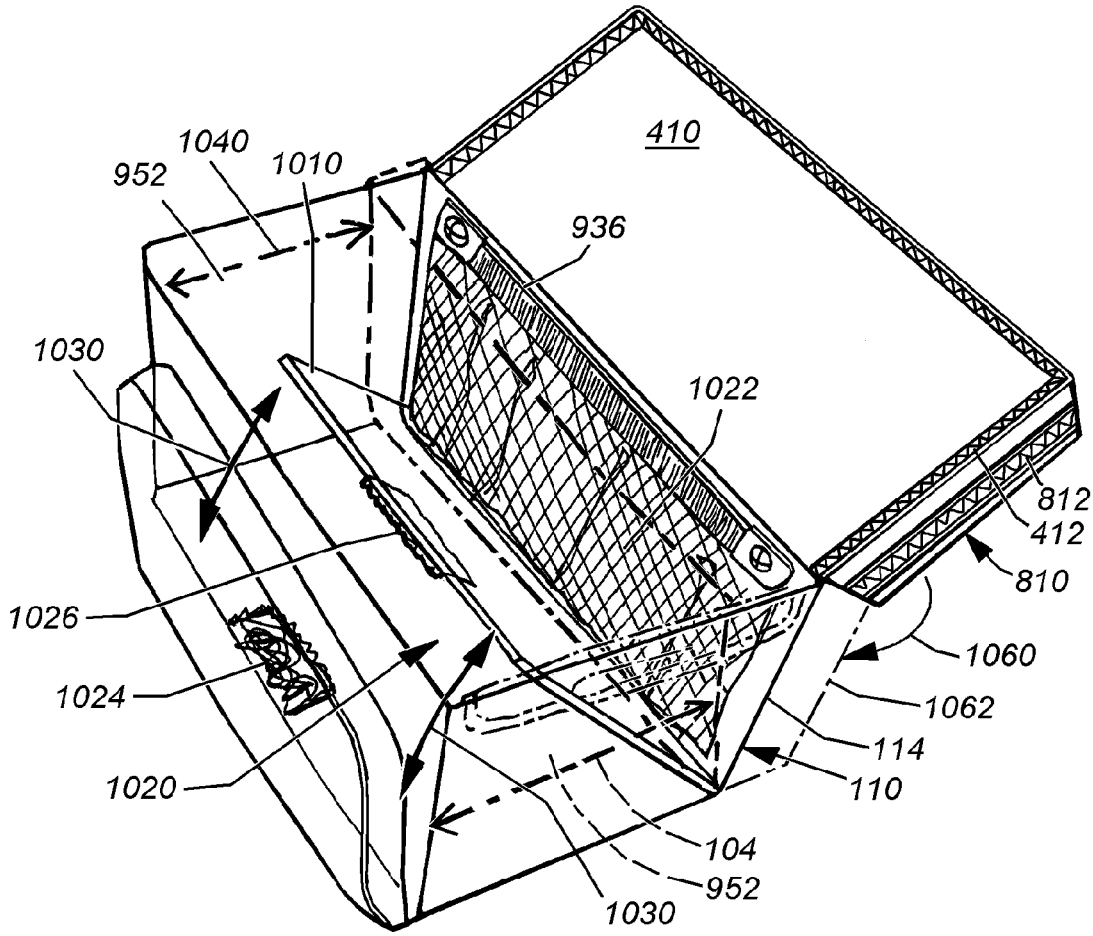
FIG. 10 is a top perspective view of the lower compartment of the lower piece with top opened and the upper compartment compressed thereinto and detailing the hinged opening of the base to allow compression of the lower compartment for storage.

As shown in FIG. 10, the lower compartment of the lower piece 110 includes a hinged semi-rigid base piece 1010 that is in a lowered position flush with a lower soft-sided base 1020 during normal use. This soft-sided base is joined to the wheel supports 210 as shown in FIG. 3. However, the hinged base piece 1010 itself typically remains unjoined to the bottom except for its hinge line 1022 and opposing hook and loop fastener arrangement 1024. The base piece 1010 hinges about the hinge line 1022 at the bottom rear corner of the compartment 114. The base piece 1010 is detachably secured to the lower soft-sided base material 1020 by a hook and loop fastener arrangement 1024 and 1026. A variety of fastener arrangements and placement of such fasteners can be provided in alternate embodiments. When (at least) the side stiffeners 950 are removed from the respective pockets 952, the upward hinging (double arrows 1030) of the stiffened base piece 1010 into a raised position against the rear face of the compartment allows the front to be compressed (double arrows 1040) into the compressed shape as shown in phantom. In this manner, the sidewalls fold in an accordion (or similar) fashion while the bottom member 1020 also folds in. This allows for substantially more compact storage of the lower piece 1010 when not in use. Likewise, the lid 812 can be folded back (curved arrow 1060) to seat along the fold line 1062 (shown in phantom). In this arrangement, the front stiffener 982 may or may not be removed.

The hinged stiffened base piece 1010 can include an integral/internal stiffener formed from a plastic sheet of appropriate thickness or another material such as composite fiber or card stock. In this embodiment, the stiffener of the base piece 1010 is integral and encased in an outer layer of material that joins to the bottom of the compartment 114 to form the hinge. In alternate embodiments, the material of the base 1010 can form a sleeve into which a removable stiffener can be placed. Alternatively, the base piece can be uncovered (by any material) and attached to the compartment's bottom by a separate hinge.

In general, the rear face of the compartment 114 is constructed with significant rigidity in this embodiment, thereby forming a "backbone" for the piece with an integral stiffener (non-removable and not shown) along at least a portion of the rear face of the lower compartment. This stiffener secures the wheel axle supports 210 as well as the base (not shown) of the telescoping handle 220. While not shown, the stiffener is conventional in design and can be constructed from an appropriate material such as fiberboard, card stock or a rigid plastic with appropriate thickness (for example, between 3–16 and 5/16 inch.

Figure 11:
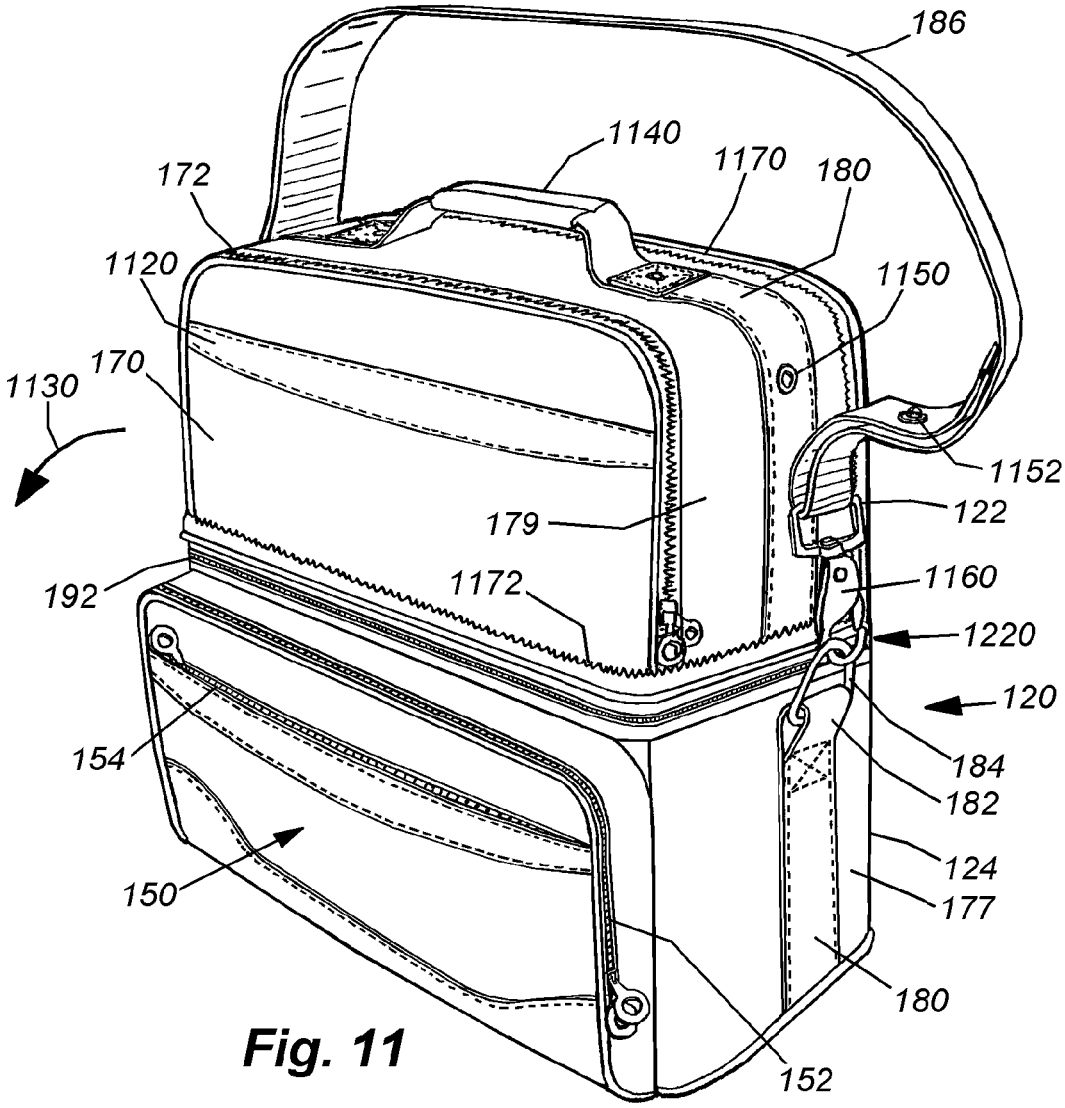
FIG. 11 is a front perspective view of the upper piece fully expanded.

Having described the various features and aspects of the lower piece 110, reference in FIG. 11 is now made to the upper piece 120 which is shown in expanded form. The front face 170 of the upper compartment 122 can include a detail 1120 that defines the mouth of a front pocket. Alternatively, this detail can be a non-functional decoration. As noted above, the upper compartment 122 and lower compartment 124 of the upper piece 120 are separated along a seam line defined by a peripheral three-sided zippered closure 192. The zippered closure extends around the sides and front face of the upper piece 120. The rear face of the upper piece includes a non-zippered seam line 1220 (see FIG. 12) that defines a hinge line about which the upper compartment 122 can hinge with respect to the lower compartment 124 when the zipper 192 is unzipped. This hinging action allows one form of access into the lower compartment 124 of the piece 120. Alternatively, the front flap 170 can be unzipped by moving the zipper 172 to an opened/detached position. In this position, the front flap 170 is allowed to hinge forward (curved arrow 130) adjacent to the zipper 192. When the flap 170 is opened, the lower compartment and upper compartment 124, 122 are both accessible. A top handle 1140 of conventional design is provided at the top end of the upper compartment 122. It joins to the opposing straps 180 of web material provided in this embodiment. A variety of other arrangements, both decorative and functional, can be provided for the handle and sidewall detail.

Notably, near the top side of the upper compartment 122 a pair of snap closures 1150 are mounted within the webbing 180. The snap fittings were detachably engaged associated fittings 1152 on the inside faces carrying strap 186. These fittings 1150 and 1152 allow the strap to be secured near the top of the piece when it is fully expanded. By securing the fasteners 1150 and 1152 together, the balance point of the strap is moved near the top. This substantially increases the stability of the piece 120 during carrying. The D-ring 184 upon which a removable strap clasp 1160 is mounted is located within the lower compartment 124. The placement of the D-ring 184 is low on the upper piece 120 so that the upper compartment 122 can be, in essence, eliminated by compression while still fully exposing the D-ring for use. As will be described further below, compression of the upper compartment 122 is facilitated by a peripheral zipper fastener that includes a first zipper half 1170 and a second zipper half 1172. The first zipper half 1170 extends around the rear face of the upper compartment 122 and faces inwardly toward the front face. The second zipper half 1172 extends around the sides and front face of the upper compartment facing upwardly from the joint zipper fastener 192. Briefly, when the zipper halves 1170 and 1172 are drawn together, they hinge-forward the upper compartment 122 into compression with respect to the lower compartment. This relationship will be described in further detail below.

Figure 12:
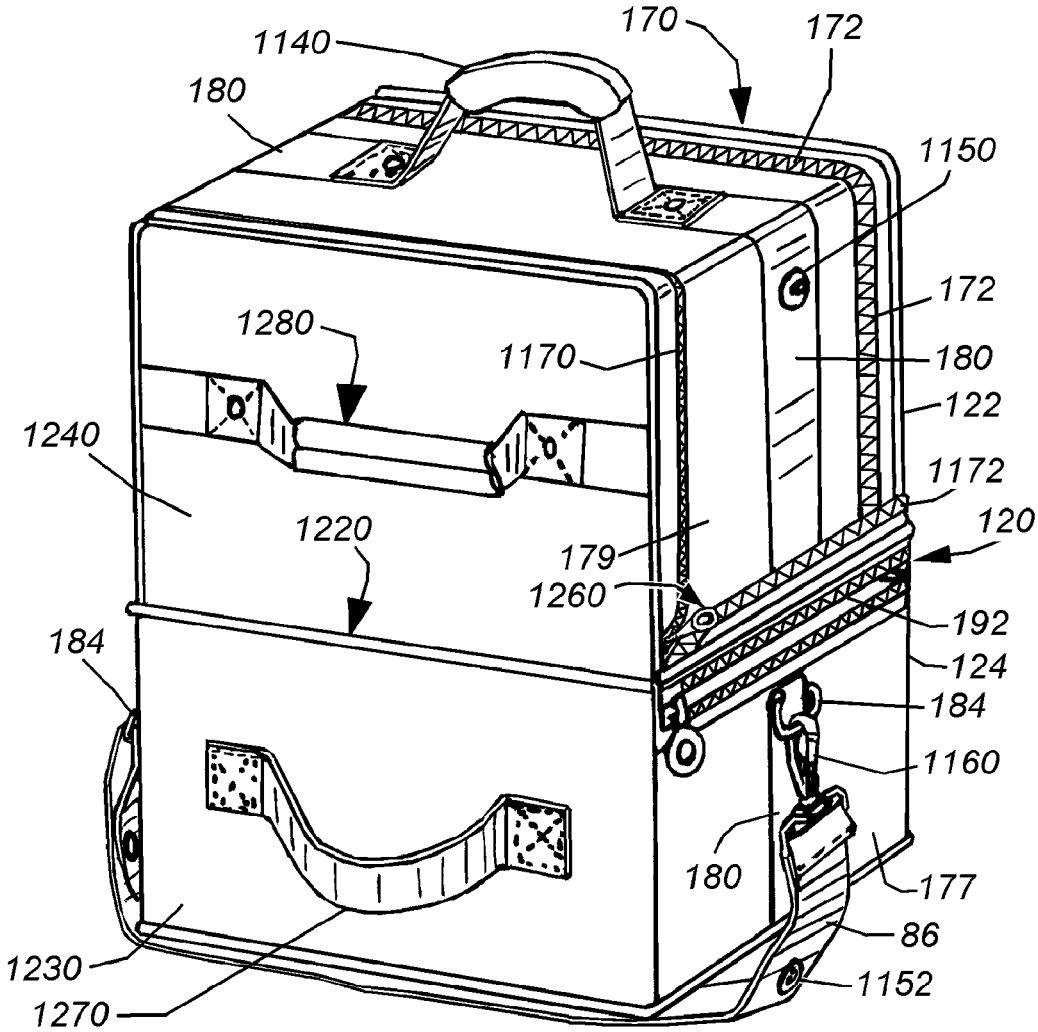
FIG. 12 is a rear perspective view of the upper piece fully expanded.

With reference to FIG. 12, the rear side of the piece 120 is shown. This rear side includes a lower compartment rear side 1230 and an upper compartment rear side 1240. Between the two rear sides is located the hinge line 1220 described above. The tab for the zipper 1260 that joins together the two zipper halves 1170 and 1172 is shown in further detail. Along the lower compartment rear face 1230 is located a simple strap handle 1270. This strap handle is sized and arranged to allow the telescoping handle 220 to pass therethrough in a manner similar to the lower piece's upper compartment handle 240. This helps to secure the upper piece 120 with respect to the handle and the lower piece 110 when the user is moving the stacked set about on its wheels 132. Similarly, the top compartment (rear faced 1240) has a centered handle 1280 that is similar and size and appearance to the upper handle 1140. As will be described further below the rear faced handle 1280 acts as a substitute handle when the upper compartment 122 is compressed. In addition, it serves as a supplemental grip as will be described further with respect to FIG. 19.

Figure 13:
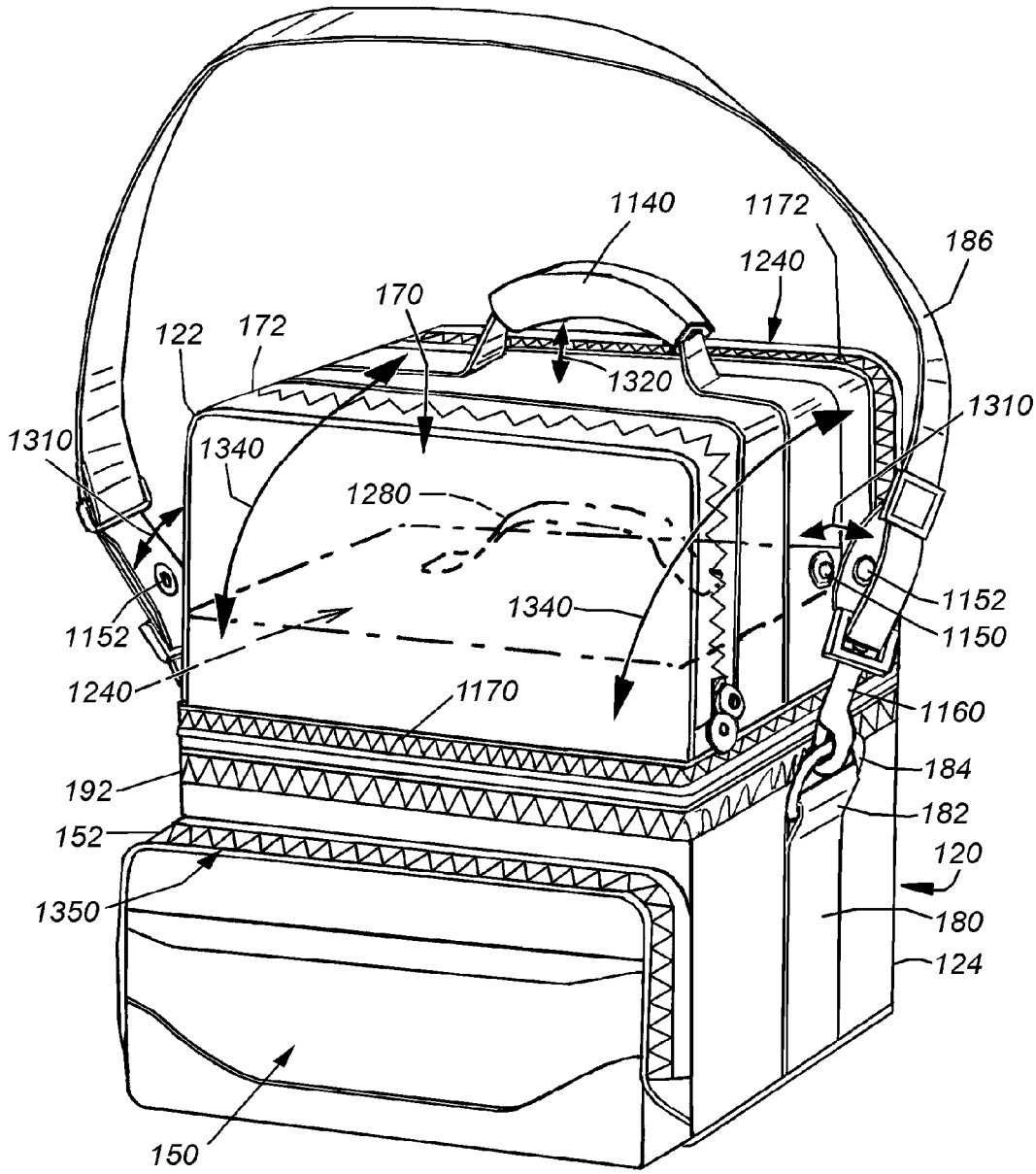
FIG. 13 is an exposed front perspective view of the upper piece detailing the foldable movement of the upper section from the fully expanded configuration to the compressed configuration.

With reference to FIG. 13, the upper compartment 122 can be moved into a compressed configuration by first detaching the strap fasteners 1152 from the corresponding bases 1150 (double arrows 1310). The handle 1140 at the top of the upper compartment is moved into a compressed position against the face of the piece (double arrow 1320). By moving the zipper tab 1260 across the zipper halves 170 and 172, the soft material of the upper compartment 120 is compressed as the rear face 1240 is rotated for (double arrows 1340) so as to eventually bring the rear face 1240 to the top of the arrangement as shown in phantom. At this time, the second handle 1280 presents itself to the top side of the now-compressed piece and the overall appearance of the upper compartment takes the form of the thickened lid 1350 shown in phantom. Also at this time, access to the lower compartment is contained only through the central zipper closure 192. Note that, in an alternate embodiment, the upper compartment and lower compartment can be sealed by an appropriate septum that prevents the compressed material of the upper compartment from infiltrating the lower compartment. Alternatively, a septum can be omitted when a certain amount of material infiltrating the lower compartment's (124) interior can be tolerated. When a septum is fitted it can be either permanently attached between the upper compartment 122 and the lower compartment 124 (generally secured to the bottom of the upper compartment 124), or the septum can be movable between opened and closed orientations using a zippered closure similar to that described below for the septum 140 of the lower piece 110.

Figure 14:
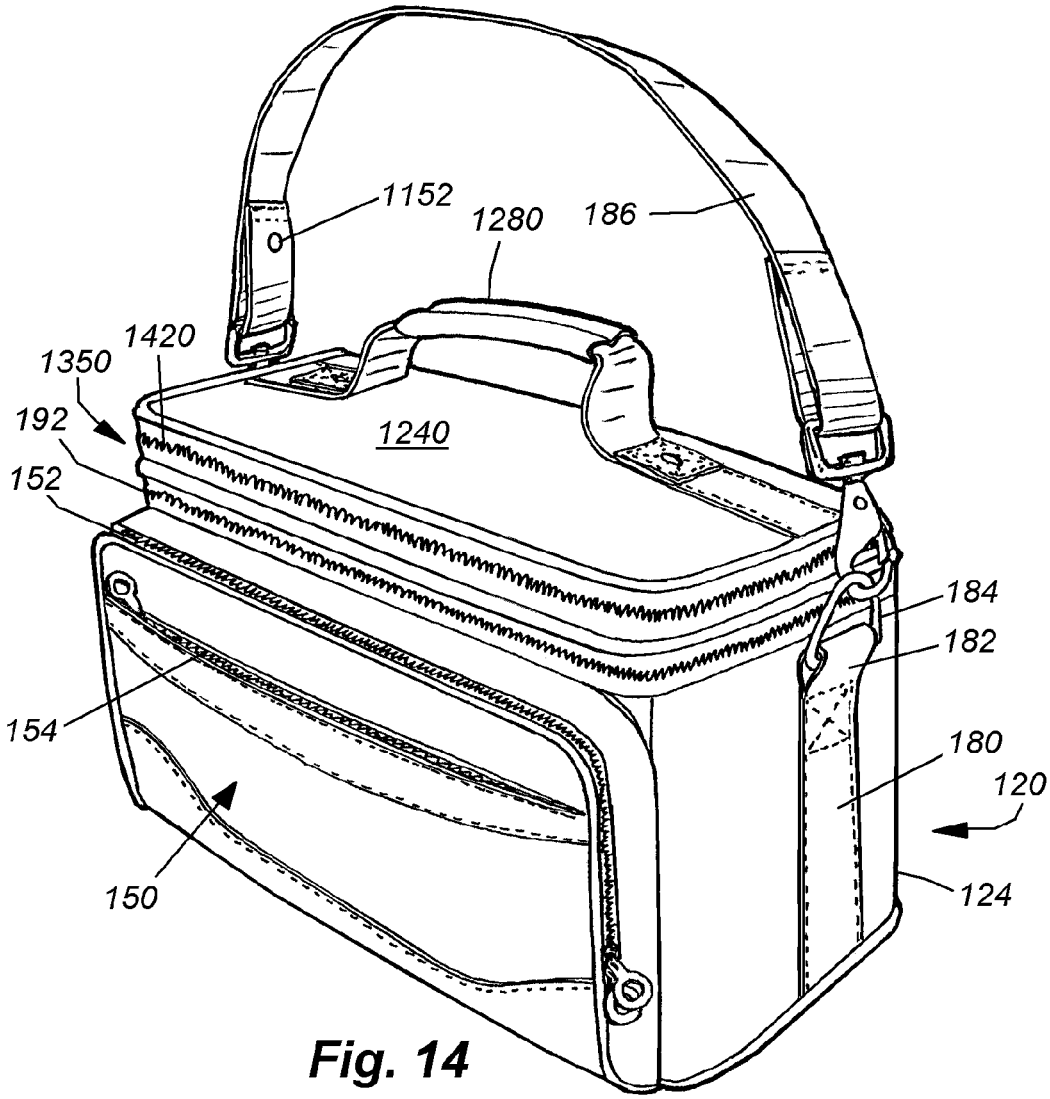
FIG. 14 is a front perspective view of the upper piece with its upper section compressed into the top.

As shown in FIG. 14, a thickened lid 1350 containing the material of the upper compartment has been formed over the lower compartment 120. The zippered closure 1420 defined by the zippered halves 1170 and 1172 is fully closed. The shoulder strap 186 is now balanced with respect to the compressed piece's shape and height, without use of its fasteners 1150 and 1152 for proper carriage piece 120 by a user. The rear face 1240 is now the piece's top side and the rear face handle 1280 is now presented to the top of the piece.

Figure 15:
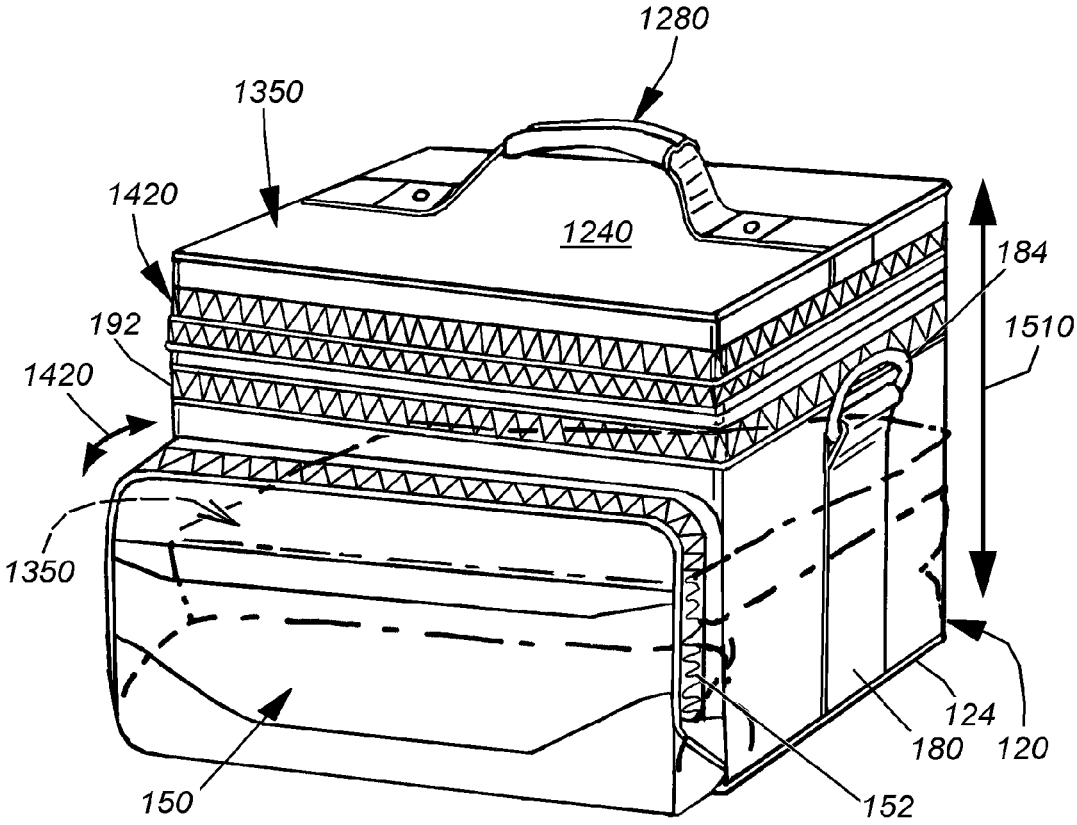
FIG. 15 is an exposed front perspective view of the upper piece with its upper section compressed into the top and detailing the vertical compression of the bottom section for storage.
Figure 16:
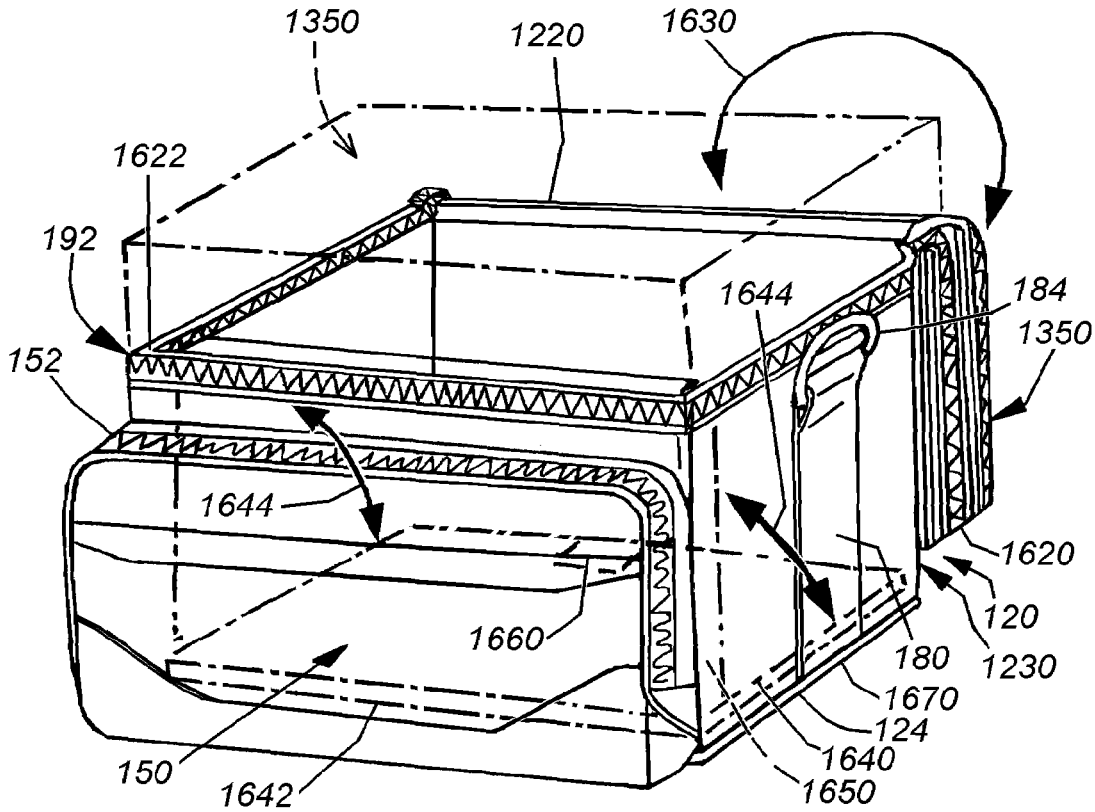
FIG. 16 is an exposed front perspective view of the upper piece with its upper section compressed into the top and detailing the hinged movement of the base and top.

While either (or both) of the upper compartment 122 and lower compartment 124 can include appropriate stiffeners in certain embodiments, it is contemplated that the upper piece 120 can, in various embodiments, be a fully soft-sided piece. It may include padding and/or other materials between plies that provide minimal rigidity (such as closed cell foam) between inner and outer fabric layers. As such, FIG. 15 shows a technique for vertically compressing (double arrow 1510) the piece 120 into the shape shown in phantom. The front pouch 152 can be rotated forwardly (double arrow 1420) the compression process to facilitate minimization of size.

Figure 17:
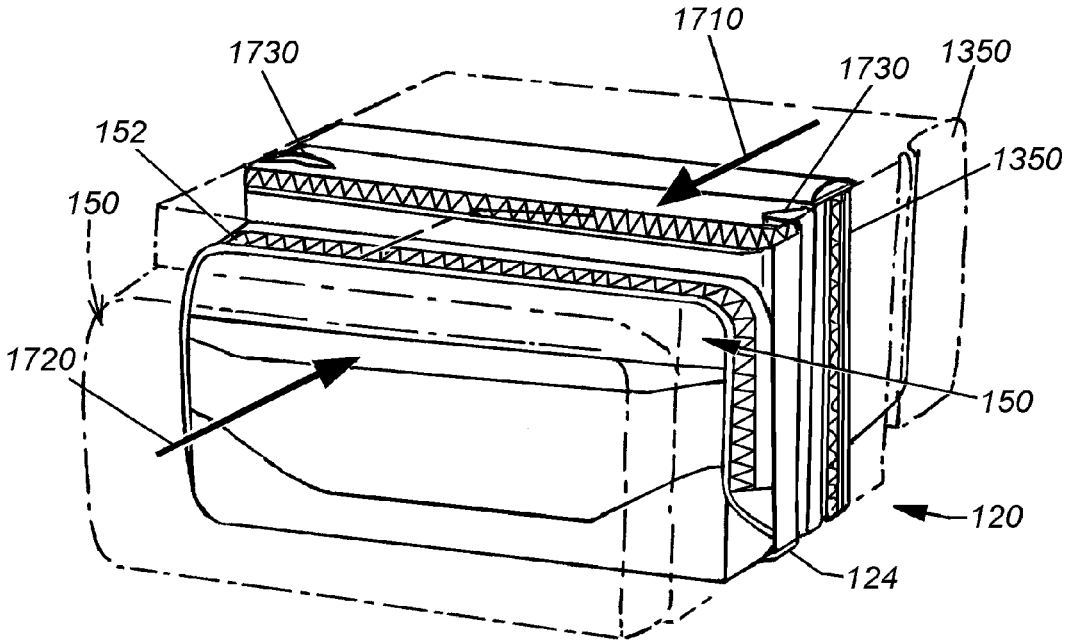
FIG. 17 is a front perspective view of the horizontal compression of the upper piece following hinged movement as detailed in FIG. 16.

Alternatively, the lower compartment 124 of the piece 120 can be accessed after hinging open the thickened lid 1350 by separating the zipper halves 1620 and 1622 of the zippered closure 192. The thickened lid 1350 is rotated rearwardly (double arrow 1630) about its rear hinge line 1220 so that it rests (in a lowered position) flatly against the lower rear face 1230 as shown. Once the interior of the lower compartment is exposed, the user can access the rigid base piece 1640 (shown in phantom) and rotate it (double arrows 1644) about its front hinge line 1642 against the inner front face of the piece as shown by the second, raised position numbered as 1650. Note that a hook and loop fastener piece 1660 is detached to allow rotation of the rigid base piece 1640. The semi-rigid base piece 1640 can include a removable stiffener or a fixed stiffener similar to the bottom piece's hinged, stiffened base piece 1010 described below. After removing the lower rigid base piece 1640, only the lower soft-sided material bottom 1670 remains. As such, the upper piece 120 can now be compressed as shown in FIG. 17 (arrows 1710 and 1720) in a horizontal compression motion. This motion causes the sides 1730 to accordion over each other, bringing the front face of the piece 120 into close engagement with its rear face and its adjacent folded-over thickened lid 1350.

Figure 18:
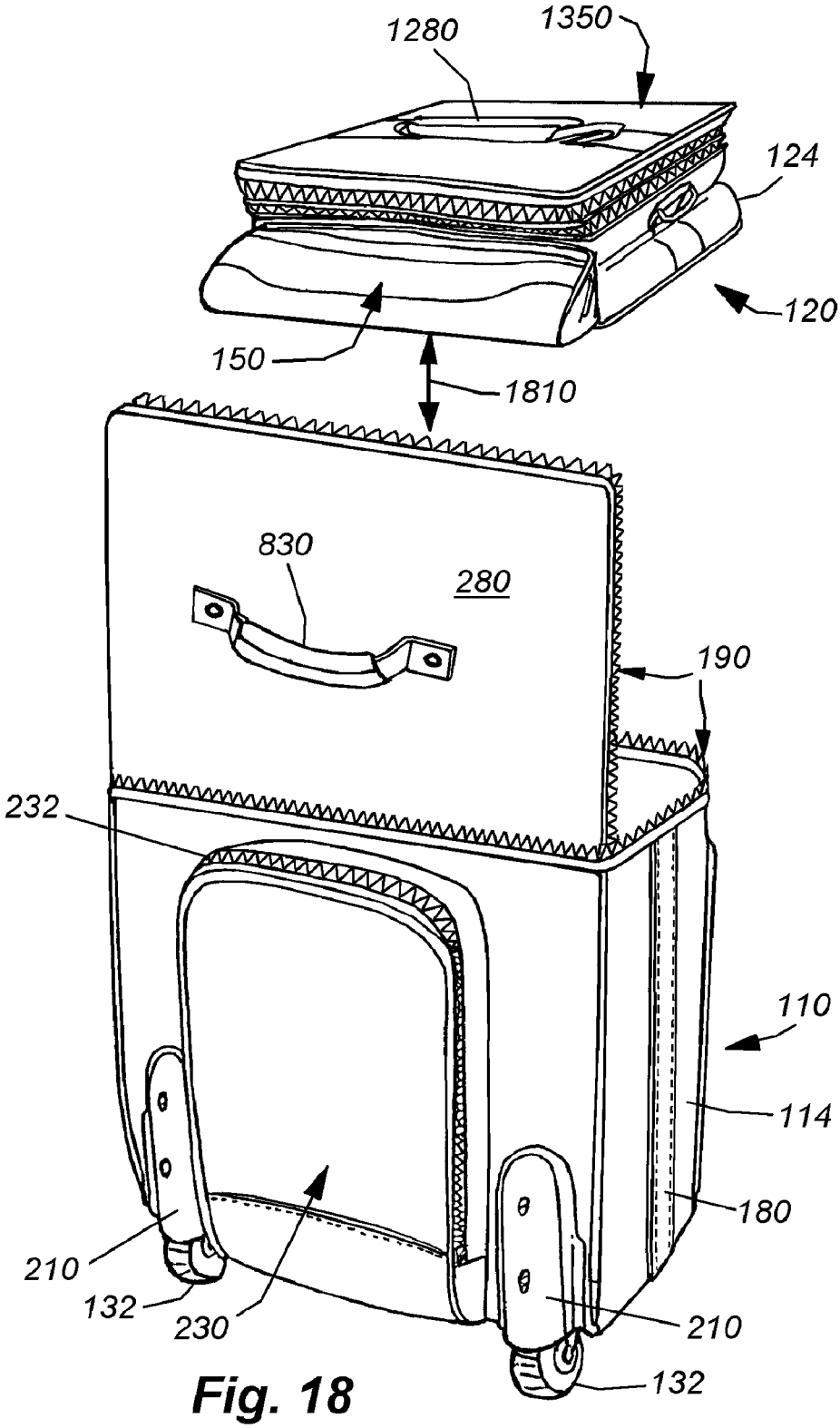
FIG. 18 is a rear perspective view of the lower piece with top opened and the upper compartment compressed thereinto and detailing the storage of the upper piece in compressed form as detailed in FIG. 17 in the lower compartment of the lower piece.

In either folded form (or, in various embodiments, also in an unfolded form) the upper piece 120 can be stored within the interior of the lower compartment 114 of the lower piece 110. As shown in FIG. 18, the thickened lid 280 is opened to allow access to the interior of the lower compartment 114. The compressed upper piece 120 (compressed in a manner described in FIG. 15) is moved (double arrow 1810) into the lower piece's interior. The thickened lid 280 may then be closed and a substantially more compact storage arrangement for the set is thereby provided. Note that the retractable handle's storage pocket 230 is sealed by zippered closure 232 with the handle assembly 220 fully retracted thereinto, and concealed, in this illustration.

Figure 19:
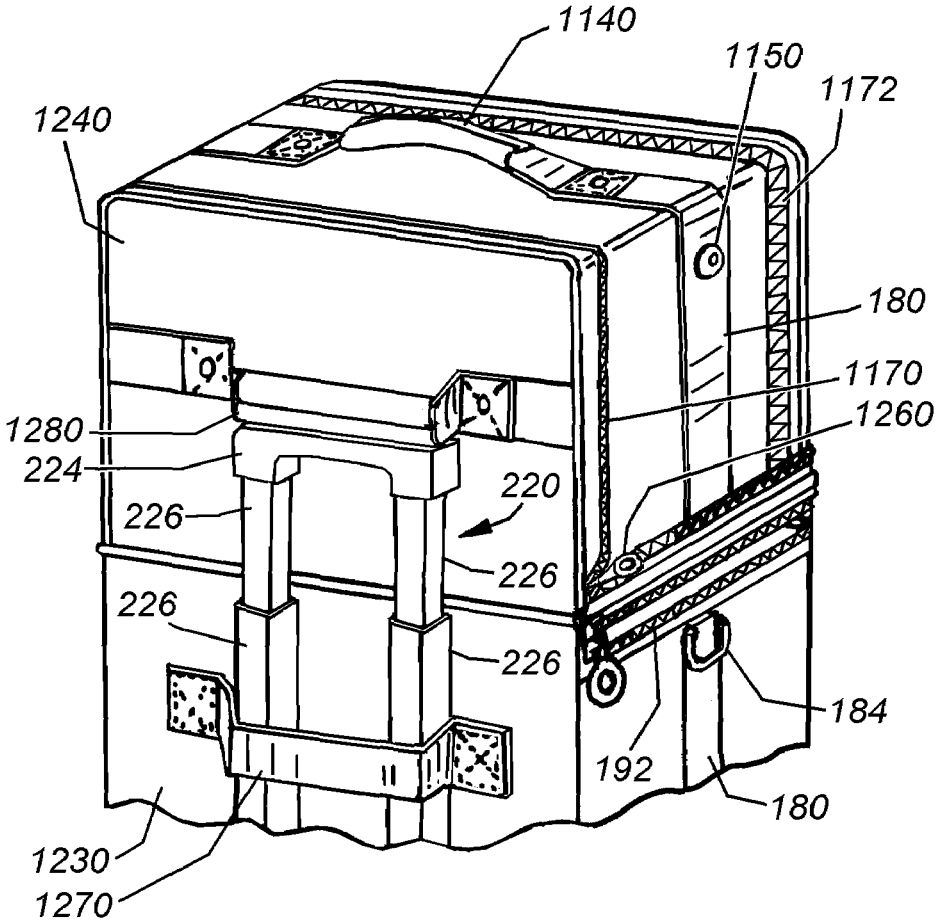
FIG. 19 is a partial rear perspective view of the upper piece in a fully expanded configuration stacked atop the lower piece and with a top handle of the upper piece brought adjacent to the top of the retractable handle for added stability during wheeled movement.

Conversely, with the handle assembly 220 fully extended, an added feature of the rear face upper piece handle 1280 is shown in FIG. 19. The top bar 224 of the telescoping handle 220 can be brought into a location relatively adjacent to the rear face handle 1280. In this position, the two handles can be gripped together by the user as the set is wheeled about, providing further stability to the upper piece 120 when it is stacked atop a lower piece 110. Note that the lower strap 1270 is mounted around the handle assembly 220 to further secure the upper piece 120 in its appropriate stacking arrangement.

The foregoing has been a detailed description of various embodiments of the invention. Certain modifications and additions can be made without departing from the spirit and scope thereof. For example, materials used for liners, outer coverings and stiffeners can be widely varied. The placement and types of fasteners used throughout this set can be varied. For example, while hook and loop fasteners are used in certain applications, snaps, magnets or buckles (or other types of fasteners) may be substituted. Likewise, certain closures utilizing zippers can be changed these other types of fasteners including hook and loop fastener strips. Additional straps, carrying handles and other accessories can be applied to any piece or compartment described herein. Similarly, the arrangement of stiffeners, their associated pouches and flap openings can be widely varied. In alternate embodiments, flaps can be omitted in other techniques for restraining stiffeners in the pouches can be employed. In still other embodiments, stiffeners may be exposed within the interior (e.g. no pouch covering layer) and secured within the interior of each piece by alternate fastening techniques such as hook and loop fasteners, tracks/sliding brackets or another suitable mechanism. Accordingly, this description is meant to be taken only by way of example and not to otherwise limit the scope of the invention.

What is claimed is:

1. A luggage piece comprising:

an upper compartment and a lower compartment, each of the upper compartment and the lower compartment being joined at a seam that includes a fastener adapted to allow the upper compartment and the lower compartment to hingedly detach from each other;

a fastener assembly that selectively moves the upper compartment from an expanded configuration, wherein the upper compartment defines a respective interior storage space, into a compressed configuration so as to form a thickened lid with respect to the lower compartment, that is substantially free of the respective interior storage space; and wherein a top side of the upper compartment in the expanded configuration and the top of the thickened lid in the compressed orientation are each adapted to receive, stacked thereon, an upper luggage piece including an top compartment and a bottom compartment, each of the top compartment and the bottom compartment of the upper luggage piece being adapted to move between an expanded configuration, wherein the top compartment of the upper luggage piece defines a respective interior storage space, and a compressed configuration, wherein the top compartment of the upper luggage piece is substantially free of the respective interior storage space, by selective movement of an upper luggage piece fastener assembly.

2. The luggage piece as set forth in claim 1 wherein the upper compartment includes a flap along a sidewall thereof constructed and arranged to be opened so as to access the upper compartment.

3. The luggage piece as set forth in claim 2 wherein the upper compartment includes, at a bottom side thereof adjacent to the seam, a septum that separates the upper compartment from the lower compartment along an interior of each of the upper compartment and a lower compartment.

4. The luggage piece as set forth in claim 3 wherein the septum includes a fastener adapted to allow the septum to be moved from a closed position in which the upper compartment interior is separated from the lower compartment interior to an open position in which the upper compartment interior and the lower compartment interior are continuous.

5. The luggage piece as set forth in claim 4 wherein the lower compartment includes, along interior sidewalls, removable stiffeners.

6. The luggage piece set forth in claim 5 wherein the lower compartment includes a hinged stiffened base piece adapted to be moved hingedly from an lowered position along a bottom side of the lower compartment and a raised position located upwardly away from the bottom side of the lower compartment.

7. The luggage piece as set forth in claim 5 wherein the upper compartment includes, along interior sidewalls, removable stiffeners.

8. The luggage piece as set forth in claim 5 further comprising a retractable handle assembly located along a rear face of the lower compartment and at least a pair of wheels located adjacent to a bottom side of the lower compartment.

9. The luggage piece as set forth in claim 8 wherein the retractable handle assembly is adapted to pass through a strap located along a rear face of the upper compartment when the upper compartment is in the expanded orientation.

10. The luggage piece as set forth in claim 1 wherein the upper luggage piece includes a shoulder strap mounted on each of a pair of bases adjacent to each of respective sides of the bottom compartment, the shoulder strap including a pair of fasteners that engage corresponding fastener bases located on opposing side walls adjacent to a top side of the top compartment of the upper luggage piece when the upper luggage piece is in the expanded configuration.

11. The luggage piece as set forth in claim 1 wherein the bottom compartment of the upper luggage piece includes a hingedly mounted stiffener base piece adapted to move hingedly along a hinge line between a lowered position adjacent to a bottom side of the bottom compartment and a raised position remote from the bottom side whereby the bottom compartment can be moved into a predetermined compressed shape for storage of the upper luggage piece in a compact form.

* * * * *